US005573307A

United States Patent [19]

Wilkinson et al.

[11] Patent Number: 5,573,307

[45] Date of Patent: Nov. 12, 1996

[54] METHOD AND APPARATUS FOR BLASTING HARD ROCK

[75] Inventors: G. Mark Wilkinson; Steven G. E. Pronko, both of San Diego, Calif.

[73] Assignee: Maxwell Laboratories, Inc., San Diego, Calif.

[21] Appl. No.: 468,795

[22] Filed: Jun. 6, 1995

Related U.S. Application Data

[63] Continuation-in-part of Ser. No. 193,233, Jan. 21, 1994, Pat. No. 5,425,570.

[51] Int. Cl.[6] ..... E21C 37/18; E21B 7/15

[52] U.S. Cl. ..... 299/14; 166/299; 175/16

[58] Field of Search ..... 299/13, 14; 175/16; 166/63, 249, 299

[56] References Cited

U.S. PATENT DOCUMENTS

| | | | |
|---|---|---|---|
| 3,583,766 | 6/1971 | Padberg | 299/14 |
| 3,679,007 | 7/1972 | O'Hare | 175/16 |
| 4,334,474 | 6/1982 | Coltharp | 102/206 |
| 4,479,680 | 10/1984 | Wesley et al. | 299/14 |
| 4,741,405 | 5/1988 | Moeny et al. | 175/16 |
| 4,895,062 | 1/1990 | Chryssomallis et al. | 89/7 |
| 4,897,577 | 1/1990 | Kitzinger | 315/55 |
| 4,974,487 | 12/1990 | Goldstein et al. | 89/7 |
| 5,012,719 | 5/1991 | Goldstein et al. | 89/8 |
| 5,052,272 | 10/1991 | Lee | 89/7 |
| 5,072,647 | 12/1991 | Goldstein et al. | 89/8 |
| 5,106,164 | 4/1992 | Kitzinger et al. | 299/14 |
| 5,287,791 | 2/1994 | Chaboki et al. | 89/8 |
| 5,425,570 | 6/1995 | Wilkinson | 299/14 |
| 5,482,357 | 1/1996 | Wint et al. | 175/16 X |

FOREIGN PATENT DOCUMENTS 357345 7/1983 U.S.S.R. .

*Primary Examiner*—David J. Bagnell
*Attorney, Agent, or Firm*—Fitch, Even, Tabin & Flannery

[57] ABSTRACT

A method and apparatus for blasting of hard rock using a highly insensitive energetic material ignited with a moderately high energy electrical discharge causing the fracturing and break up of the hard rock is provided. The blasting apparatus comprises a reusable blasting probe including a high voltage electrode and a ground return electrode separated by an insulating tube. The two electrodes of the blasting probe are in electrical contact with a continuous volume of highly insensitive yet combustible material such as a metal powder and oxidizer mixture. The metal particles within the metal powder and oxidizer mixture form a plurality of fusible metal paths between the high voltage electrode and the ground return when subjected to an electric current delivered from a large capacitor bank coupled to the high voltage electrode. The plurality of fused metal paths act much like a fuse in that they provide a sufficiently high electrical resistance to allow coupling of the electrical energy from the capacitor bank to the metal powder and oxidizer mixture causing an increased dissipation of heat which initiates an exothermic reaction of the metal powder and oxidizer mixture generating high pressure gases fracturing the surrounding rock.

26 Claims, 6 Drawing Sheets

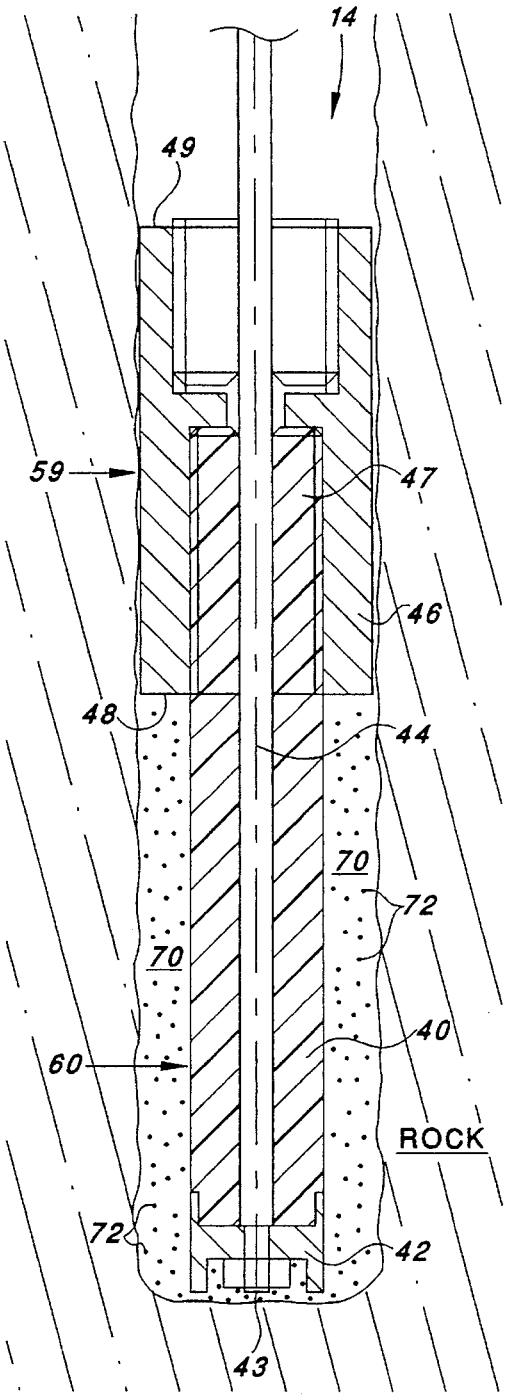
FIG. 3
FIG. 4
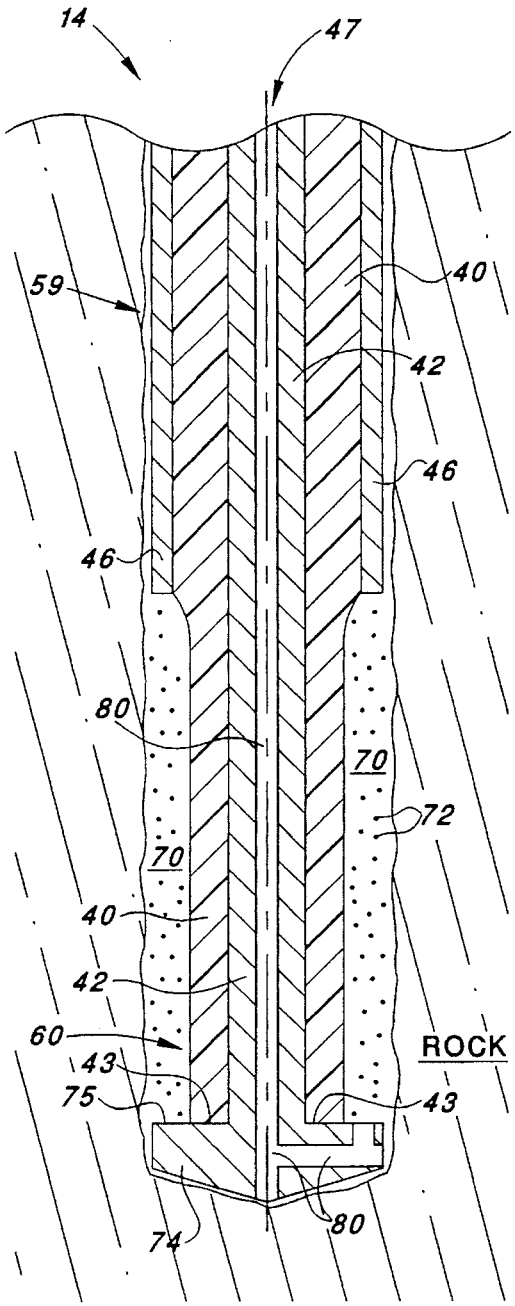

METHOD AND APPARATUS FOR BLASTING HARD ROCK

This application is a continuation-in-part application of U.S. Pat. application Ser. No. 08/193,233 filed Jan. 21, 1994 now U.S. Pat. No. 5,425,570

FIELD OF THE INVENTION

The invention relates generally to a method and apparatus for blasting hard rock, and more particularly, to a method and apparatus for blasting of hard rock using a highly insensitive fuel mixture ignited with a moderately high energy electrical discharge which produces rapidly expanding gases within a confined area causing the fracturing and break up of the hard rock.

BACKGROUND OF THE INVENTION

Hard rock mining is typically facilitated by mechanical equipment such as drills and other dedicated machinery, chemical explosives such as TNT, and/or electrical blasting methods using high energy electrical discharges across spark gaps to create a plasma from an arc of current. The chemical and electrical blasting methods produce rapidly expanding gases within a confined area at the end of holes drilled into rock and thus break up the rock. Where practical, electrical blasting methods are generally preferred because they are less volatile than chemical explosives such as TNT and generally safer to use. Furthermore chemical explosive materials are susceptible to unintended detonation through physical changes, electrical apparatus initiate explosions only through coupling electrical energy and are otherwise inert. The use of mechanical equipment is the most inefficient and time consuming technique used in hard rock mining and thus is often used in combination with blasting techniques.

Electrical blasting methods such as exploding wire and spark gap systems are known for producing an explosion or the venting of a propellant gas. Exploding wire propulsion systems are exemplified by U.S. Pat. No. 5,052,272 to Lee entitled "Launching Projectiles with Hydrogen Gas Generated from Aluminum Fuel Powder/Water Reactions" issued Oct. 1, 1991. Lee discloses a method of generating hydrogen gas with high energy efficiency by applying pulse power techniques to a trigger wire or foil and eventually to an aluminum fuel powder-oxidizer mixture. The preferred oxidizer for the aluminum fuel powder is water. The apparatus includes a capacitor bank connected to an induction coil. A metal wire is connected to the induction coil and a fast switch. when the switch is closed, electrical energy from the capacitor bank flows through the inductor and the switch as well as the wire. The total energy of the electrical discharge is preferably from 0.50 to 15 kilojoules per gram of aluminum fuel. The discharge lasts between 10 and 1000 microseconds.

Another related exploding wire blasting system is disclosed in U.S. Pat. No. 3,583,766 to Padberg, Jr., entitled "Apparatus For Facilitating The Extraction of Minerals From The Ocean Floor, " issued Jun. 8, 1991. In particular, the '766 patent discloses a deep submergence search vehicle having a drill pipe into a bore formed in a layer of mineral deposits and extending into a sedimentary ocean bed. A drill head is positioned at the lower end of the drill pipe with a plasma discharge section positioned above the drill head. An energizing circuit couples the electrical energy from a power source to a thin nickel wire extending through the plasma discharge section. When a switch is closed, a high current is suddenly passed through the thin nickel wire exploding it and creating a large plasma discharge accompanied by sharp pressure waves. Openings in the plasma discharge section allow the pressure waves to emerge and produce a rapidly expanding and collapsing gas bubble with accompanying shock waves simulating those of explosives. The bubble expansion and collapse propagates acoustic waves in the form of sharp pressure pulses.

Still another related art exploding wire blasting system is disclosed in Soviet Union No. SU357345A to Yutkin which shows a rock breaking device having a pair of electrodes and a conductive wire strip for insertion in a hole in rock filled with a wetted dielectric bulk material, such as sand, to produce shock waves when energized. The wire is connected to the electrodes and stretched around a dielectric plate. The dielectric plate is positioned in the rock hole for bursting operation.

Spark gap or non-exploding wire systems are exemplified by U.S. Pat. No. 3,679,007 to O'Hare, entitled "Shock Plasma Earth Drill," issued Jul. 25, 1972, which disclose a spark gap probe for drilling deep holes in the earth for the recovery of water or oil. The probe has a center electrode separated from and surrounded by an outer electrode both of which are immersed in water. A condenser or capacitor bank is charged to a potential of 6000 to 30000 volts (depending upon soil conditions) which supplies electrical energy to the electrodes. Rapid release of electrical energy across the resistance of the water produces a large amount of heat to produce an explosive effect. The explosive shock waves generated in the water move downward and outward to produce a hole into which the earth drill repeatedly falls.

U.S. Pat. No. 4,741,405 to Moeny et al., entitled "Focused Shock Spark Discharge Drill Using Multiple Electrodes," issued May 3, 1988, discloses a spark gap discharge drill for subterranean mining. The drill delivers pulses of energy ranging from several kilojoules up to 100 kilojoules or more to a rock face at the rate of 1 to 10 pulses per second or more. A drilling fluid such as mud or water assists propagation of the spark energy to the rock face.

U.S. Pat. No. 5,106,164 to Kitzinger et al., entitled "Plasma Blasting Method," issued April 21, 1992, discloses a plasma blasting process for fragmenting rock in the practice of hard rock mining and more particularly teaches a method which uses rapid and very high energy discharges across electrodes in an electrolyte. The electrical energy from a capacitor bank is switched to supply 500 kiloamperes to a blasting electrode positioned within a bore in a rock face causing dielectric breakdown of an electrolyte, preferably containing copper sulfate. The electrolyte may be gelled with bentonite or gelatin to make it viscous enough so that it does not leak out of the confined area prior to blasting. The blasting apparatus has minimal inductance and resistance in order to reduce power loss and ensure rapid discharge of energy into the rock.

Whereas the electrical blasting methods taught thus far us simple electric spark gaps and exploding wires to generate a very large electrical discharge from charge stored in capacitors delivering hundreds of kiloamperes of current and may involve the use of electrolytes, it would be desirable to develop a blasting method operable at more moderate energy levels. Additionally, most of the prior art high voltage electrical methods transfer the energy from the capacitor bank to the explodable conductor or spark gap in a relatively inefficient manner. As a result of the inefficient transfer of energy, the related art systems need relatively large capacitor banks for driving either the explodable conductor or the spark gap to provide a given amount of explosive energy.

Alternatively, many blasting systems that utilize chemical explosives present significant safety concerns due to the sensitive nature of common explosive materials. Many explosive materials are susceptible to unintended detonation through physical impact, stray electric charges, and severe environmental conditions (i.e. high temperatures). In addition, many blasting techniques that utilize chemical explosive materials can produce toxic by-products and often pulverize surrounding rock material, which can be undesirable in some applications. Thus, it may be desirable to develop an approach to breaking rock in which highly insensitive and non-toxic explosives are utilized which require only moderate energy electrical initiation or ignition as is used in electrical blasting systems. Such a combination would present a safe, economical and efficient blasting technique that is somewhat more gentle fracturing process than is offered with a high explosive charge.

It would also be desirable to combine relatively safe chemical blasting methods and/or electrical blasting methods with mechanical drills thereby speeding up the drilling/blasting process and facilitating its automation. Many hard rock mining operations typically involve both drilling and blasting operations, that if properly combined or integrated would eliminate the need to withdraw the mechanical equipment from the bore hole and insert a separate blasting probe or explosive charge. Several of the aforementioned related art attempt to combine the drilling and blasting processes within a single piece of equipment. See e.g. U.S. Pat. No. 3,679,007 to O'Hare; U.S. Pat. No. 4,741,405 to Moeny et al.; and U.S. Pat. No. 3,583,766 to Padberg Jr. Due primarily to the destructive nature of many chemical blasting techniques, none of these related art systems have successfully combined chemical blasting techniques with the mechanical drills.

SUMMARY OF THE INVENTION

The present invention advantageously addresses the above and other needs by providing a method and apparatus for blasting of hard rock using a highly insensitive fuel mixture initiated with a moderately high energy electrical discharge which produces rapidly expanding gases within a confined area causing the fracturing and break up of the hard rock. The present invention uses a fusing means that is contained entirely within the fuel mixture to couple the electrical energy to the fuel mixture. This self-contained fusing means functions both as a switching means for coupling the electrical energy into the fuel mixture and as a source of ignition of the subsequent exothermic chemical reaction. Moreover, the design of the blasting apparatus is such that it is both reusable and is easily integrated with mechanical drilling equipment.

In accordance with one aspect of the invention, the blasting apparatus includes a reusable blasting probe in the form of a coaxial electrode assembly that includes a high voltage electrode and a ground return electrode separated by an insulating tube. The two electrodes of the coaxial electrode assembly are in electrical contact with a continuous volume of highly insensitive yet combustible material such as a metal powder and oxidizer mixture. The metal powder and oxidizer mixture is preferably contained within an annular void region proximate the coaxial electrode assembly. The high voltage electrode is coupled to a capacitor bank via a high current switch.

The configuration of the blasting probe is such that one of the electrodes is comprised of a conductive sheath disposed on an outer surface of the insulating tube near the back end of the blasting probe. The second electrode is disposed within the insulating tube and exposed at the distal end of the insulating tube so as to be in communication with the metal powder and oxidizer mixture. The metal particles within the metal powder and oxidizer mixture form a plurality of fusible metal paths between the high voltage electrode and the ground return electrode when subjected to an electric current delivered from the capacitor bank. The metal paths function much like a fusing element in that they provide an electrical resistance to allow coupling of the electrical energy from the capacitor bank to the fuel mixture causing an increased dissipation of heat which initiates an exothermic reaction of the metal and oxidant generating high pressure gases fracturing the surrounding rock.

In accordance with another aspect of the invention, the blasting apparatus is integrated with a conventional rock drill, such as a rotating hammer rock drill. The blasting apparatus includes a reusable blasting probe that is essentially a coaxial electrode assembly formed with a metal sheath disposed on a portion of the outer surface of an insulating tube or sleeve. The metal sheath is electrically coupled to a capacitor bank via a high current switch. The insulating tube is dimensioned to slidably traverse over the drill steel, with the drill steel functioning as a ground return electrode. The configuration of the reusable blasting probe is particularly adapted to create an annular void region of a prescribed volume when inserted within the drilled hole. This annular void region is adapted for retaining a prescribed volume of a suitable working fluid. Again, the preferred working fluid is a metal powder and oxidizer fuel mixture which is disposed within the annular void region near the distal end of the hole and immediately behind the drill bit of the rock drill. The blasting probe becomes operational when the annular void region is filled with the fuel mixture or other working fluid and the metal sheath and the drill steel are placed in electrical contact therewith.

When properly used, the blasting apparatus integrated with the rock drill advantageously speeds up the drilling/blasting operations by eliminating the need to withdraw the drilling equipment from the hole prior to inserting the blasting probe. In particular, the insulating tube is retracted up the drill steel and away from the hole during the drilling operations. Upon completion of the drilling phase, the blasting probe is inserted into the hole by moving it down the shaft of the drill steel. The metal powder and oxidizer mixture is then introduced into the newly drilled hole via a conduit in the drill steel after the blasting probe is positioned or can be introduced from a separate nozzle prior to sliding the blasting probe into the hole. A high voltage pulse is applied from the capacitor bank to the metal sheath on the blasting probe. As indicated above, the metal particles within the metal powder and oxidizer mixture form a plurality of fusible metal paths between the metal sheath and the drill steel when subjected to an electric current delivered from the capacitor bank via the metal sheath or high voltage electrode. The plurality of metal paths act as a fuse to provide sufficiently high electrical resistance to allow coupling of the electrical energy from the capacitor bank to the metal and oxidizer fuel mixture causing an increased dissipation of heat which initiates an exothermic reaction of the metal and oxidizer fuel mixture generating high pressure gases within the hole and fracturing the surrounding rock.

An important advantage of the present invention is realized by connecting an inductor between the capacitor bank and the high voltage electrode. By transferring the electrical charge from the capacitor bank through the inductance, the rate of change in the electric current delivered to the metal and oxidizer fuel mixture via the high voltage electrode can be controlled.

Yet another advantage of the present invention is realized by the absence of a separate fusing element, such as an exploding wire, explodable conductor and the like. The fusing means for the metal powder and oxidizer fuel mixture is the metal particles of the fuel mixture and is thus completely contained within the fuel mixture. Advantageously, the present blasting apparatus does not require a separate fuse or fusing element to initiate or ignite the energetic material as is present in some of the related art systems.

A particular feature of the present invention is the optional inclusion of a central fuel filling port in the blasting apparatus that allows for in-situ filling of the annular void region with the metal powder and oxidizer fuel mixture. Alternatively, a non-conductive retaining sleeve or other suitable means for retaining the metal powder and oxidizer fuel mixture in the annular void region proximate the coaxial electrode assembly can be used where it is advantageous to pre-load the metal powder and oxidizer fuel mixture before positioning the blasting probe at the blasting site.

Another feature of the present invention which provides good confinement of the subsequent blast involves selecting the dimensions of the coaxial electrode assembly such that the outside diameter of the metal sheath is only slightly smaller than the diameter of the blasting hole. Blast confinement is further improved by utilizing a deformable or expandable element that radially expands when compressed. This deformable or expandable element can be made from an elastomeric material such as polyurethane or silicon rubber. Thus, when the coaxial electrode assembly or blasting apparatus is pushed forward into a blasting hole, the elastomeric element expands radially outward against the rock, thereby substantially preventing the high pressure gases from escaping via the drill hole.

The invention may also be characterized as a method for blasting hard rock using a highly insensitive fuel mixture ignited with a moderately high energy electrical discharge. The method includes the steps of (1) placing a prescribed volume of a metal powder and oxidant fuel mixture in communication with a pair of electrodes proximate the rock formation, the fuel mixture having a sufficiently high metal content so as to form a plurality of fusible metal paths between the electrodes; (2) applying a moderately high pulse of electric current to the volume of the fuel mixture; (3) fusing the plurality of fusible metal paths to form a resistive arc channel between electrodes and within the fuel mixture thereby producing a sufficiently high electrical resistance; and (4) dissipating a sufficient amount of heat caused by the electrical resistance of the fuel mixture to initiate an exothermic reaction of the fuel mixture generating rapidly expanding gases within a confined area causing the fracturing and break up of the hard rock.

BRIEF DESCRIPTION OF THE DRAWINGS

The above and other aspects, features and advantages of the present invention will be more apparent from the following more particular description thereof, presented in conjunction with the following drawings wherein:

FIG. 3 is a cross-sectional view of the blasting probe shown in FIGS. 1 and 2 positioned in a drill hole;

FIG. 4 is a cross-sectional view of another embodiment of the blasting probe positioned in a drill hole;

Corresponding reference characters indicate corresponding components throughout the several embodiments shown in the drawings.

DETAILED DESCRIPTION OF THE INVENTION

The following description is of the best mode presently contemplated for carrying out the invention. This description is not to be taken in a limiting sense, but is made merely for the purpose of describing the general principles of the invention. The scope of the invention should be determined with reference to the claims.

Figure 1:
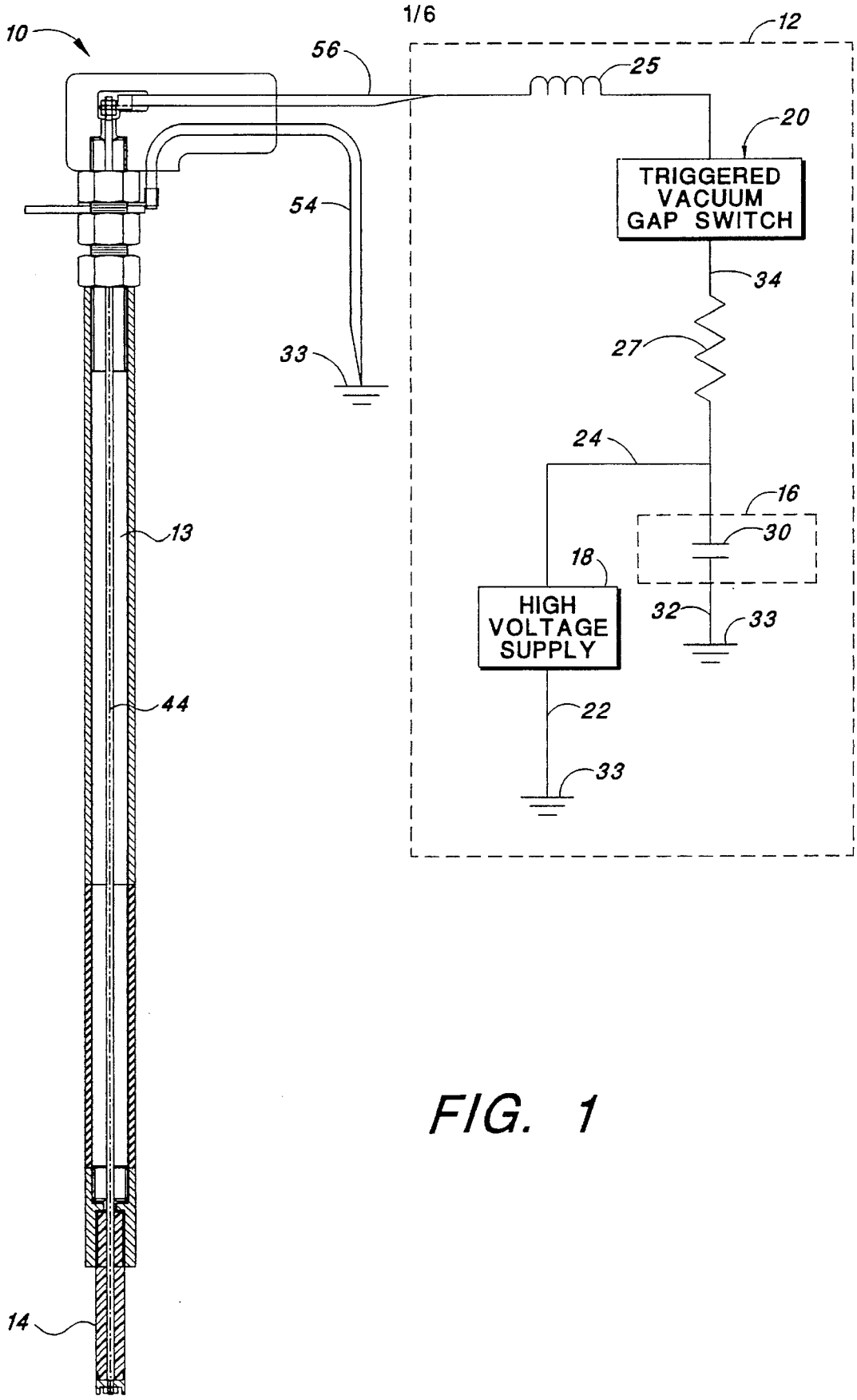
FIG. 1 is a schematic diagram of the blasting apparatus including an electrical driver circuit, conduit means and blasting probe in accordance with the present invention.

Referring now to the drawings and especially to FIG. 1, an apparatus for blasting hard rock embodying the present invention is shown therein and generally identified by reference numeral 10. The apparatus 10 includes a driver circuit 12 for supplying pulsed high current, high voltage energy to a blasting probe 14 via a high voltage conductor 44 contained within a conduit means 13. The blasting probe 14 is adapted to be placed in a rock formation or other solid structure that is to be blasted. The driver circuit 12 includes a charge storage device or capacitor bank 16, a high voltage supply 18, a switching means 20, and inductive means 25.

In the illustrated embodiment, the capacitor bank 16 comprises only one 50-kilojoule capacitor 30 with a capacitance of 830 microfarads. It is contemplated, however, that a plurality of capacitors connected in parallel could also be used. A ground lead 32 connects a ground side of the capacitor bank 16 to a ground potential 33. The capacitor bank 16 provides a means for storing the moderately high electrical charge that is switchably coupled via lead 34 to the blasting probe 14.

The driver circuit 12 also includes a conventional power supply 18 for charging the capacitor bank 16. The power supply is connected to the capacitor bank 16 via a ground lead 22 and a lead 24. The capacitor bank 16 is preferably operated at 10 kilovolts thus storing approximately 40 kilojoules. The capacitor bank 16 is connected to the blasting probe 14 via the switching means which preferably comprises a triggered vacuum gap switch 20, suitable for moderately high voltage operation. While the triggered vacuum gap switch is used in the present embodiment, any other high coulomb switches would work as well, including a high-coulomb spark gap, an ignitron, or even a heavy duty mechanical closing switch.

The driver circuit 12 also includes an inductive means which, in this embodiment, comprises a distributed inductance of about 5 microhenries and is represented in FIG. 1 by an inductor 25. The distributed inductance receives the current and slows the rate of change of the current supplied to the blasting probe 14. In addition to the distributed inductance (shown as element 25), the driver circuit 12 also has a very small distributed resistance (shown as element 27) and a total capacitance of about 830 microfarads, capable of storing about 40 kilojoules operating at 10 kilovolts.

Figure 2:
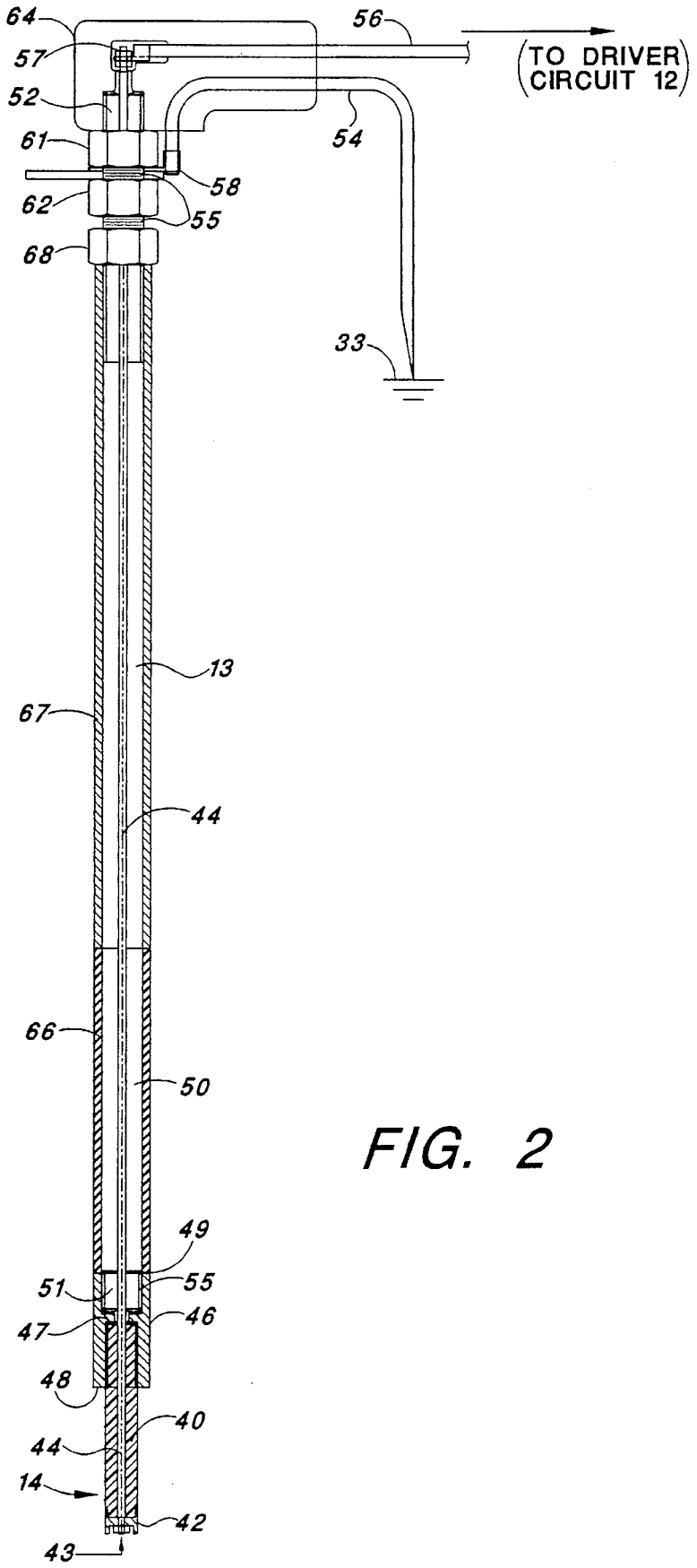
FIG. 2 is a sectional view of the electrical blasting probe and conduit means shown in FIG. 1.

Referring to FIG. 2 and FIG. 3, an embodiment of the reusable blasting probe 14 with a conduit means 13 is illustrated. The blasting probe 14 is attached to the end of the conduit means 13, preferably a conductive conduit 50, and extends axially therefrom such that the blasting probe 14 and conduit 50 can be inserted into a hole drilled into a rock face. The blasting probe 14 includes an insulating tube 40 with a high voltage steel electrode 42 at its distal end 43 which is connected to the capacitor bank of the driver circuit by means of a internally disposed high voltage conductor 44 which runs through the insulating tube 40 and the length of the conduit means 13. The high voltage conductor 44 is preferably a 0.25 inch diameter, Kapton insulated, copper rod. The insulating tube 40 is a 1.00 inch diameter tube of G-10 Fiberglass. A steel adapter plug 46 is threadably secured to the insulating tube 40 and which serves as the ground return electrode. In the illustrated embodiment, the steel adapter plug 46 resembles a female-female threaded connector with one end 48 of the steel adapter plug 46 dimensioned to threadably receive the proximal end 47 of the insulating tube 40 and the other end 49 of the steel adapter plug 46 dimensioned to threadably receive the conductive conduit 50. The high voltage conductor 44 runs axially through the steel adapter plug 46 and is insulated therefrom.

The conduit 50 is preferably a steel tube adapted to engage the adapter plug 46 of the blasting probe 14 at one end 51 while connecting to a ground return cable 54 at the other end 52. The ground return cable 54 is connected to a ground potential 33. The conduit 50 is preferably a 1.25 inch outside diameter by 0.375 inch inside diameter tube made from hardened Chromium-Molybdenum Steel have several threaded portions 55. The threaded portions 55 of the steel tube 50 are particularly adapted for connecting and/or coupling the steel tube 50 to the blasting probe 14 and/or the driver circuit. The high voltage conductor 44 runs through the interior of the steel tube 50 and is connected to the high voltage cable 56 leading to the capacitor bank within the driver circuit 12.

The hardware used to facilitate the connections between the conduit/blasting probe apparatus and the driver circuit 12 include cable lugs 57, 58, clamping nuts 61, 62, and an appropriate insulating protector 64. The invention, however, is by no way limited to the manner in which the electrical connections are made and any suitable electrical connecting means is contemplated. Moreover, the dimensions of the blast probe 14 and conduit 50 can be selected to suit the particular blasting operation in which they are used. By selecting the dimensions of the blasting probe 14 such that the outside diameter of the adapter plug 46 is only slightly smaller than the diameter of the blasting hole good confinement of the subsequent blast can be achieved. In addition, the overall length of the blasting probe 14 is preferably selected based on the volume of the fuel mixture to be used in the subsequent blast.

The conduit 50 also incorporates an additional means for confining the subsequent blast proximate the blast probe 14 which takes the form of a radial expansion plug 66. In particular, an elastomeric expansion plug 66 is disposed on the outer surface of the conduit 50. The outer diameter of the elastomeric expansion plug 66 is preferably slightly smaller than the diameter of the blasting hole (i.e. 1.75 inch outside diameter). The elastomeric expansion plug 66 is adapted to radially expand against the rock surface of a drill hole when compressed in the axial direction. In the present embodiment, the expansion plug 66 rigidly abuts the adapter plug 46 while a compressive force is applied with a sliding pusher sleeve 67 axially forced against the expansion plug 66 using a hex pusher nut 68. The expansion plug 66 is preferably made from an elastomeric material such as polyurethane or high-durometer rubber and thus radially expands outward against the rock surface as the hex pusher nut 68 is threadably moved downward moving the pusher sleeve 67.

As seen more clearly in FIG. 3, the back end 59 of the blasting probe 14 has an adapter plug 46 threadably secured on the outer surface of the insulating tube 40, and has an outer diameter slightly smaller than the diameter of the hole. The forward section 60 of the blasting probe 14 has an outer diameter equal to the outer diameter of the insulating tube 40. Because of the non-uniform diameter of the blasting probe 14, an annular void region 70 is formed proximate the forward section 60 of the blasting probe 14. This void region 70 is reserved for the blasting fluid which is preferably a metal powder and oxidizer fuel mixture 72. When the metal powder and oxidizer fuel mixture 72 is present in the annular void region 70, the two electrodes of the blasting probe 14 (the high voltage electrode 42 at the distal end and the adapter plug 46 at the back end) are in electrical contact with the continuous volume of the conductive fuel mixture 72. The metal particles within the metal powder and oxidizer fuel mixture form a plurality of fusible metal paths between the high voltage electrode 42 and the ground return electrode 46 when subjected to an electric current delivered from the large capacitor bank. These multiple metal paths act like a fuse to provide a high electrical resistance to allow coupling of the electrical energy from the capacitor bank to the metal powder and oxidizer fuel mixture causing an increased dissipation of heat which initiates an exothermic reaction of the metal and oxidant fuel mixture generating high pressure gases fracturing the surrounding rock.

The preferred fuel mixture 72 comprises a metal or metal hydride in combination with an oxidant. Most particularly, the propellant is aluminum in a particulate form suspended in water containing a gelling agent to prevent the aluminum from settling out. For example, a mixture of 50% water, 50% aluminum powder having an average particle diameter of about 5 microns, and a small amount (i.e. 1%) of gelling agent such as Knox gelatine is a suitable fuel mixture for use with the present blasting apparatus. Alternatively, other metal powders including, but not limited to, titanium, zirconium, or magnesium, alone or in combination with aluminum, which exothermically react with water providing a rapidly expanding gas will also be an acceptable fuel mixture in accordance with the invention.

The preferred aluminum powder and oxidant fuel mixture is ignited in the range of about 700° C. to 1200° C., which is achieved by producing a sufficiently high electrical resistance within the fuel mixture. The high resistance can be created within the fuel mixture without the need for an external fuse if there is a sufficiently high content of metal particles so that the metal particles of the fuel mixture form a plurality of metal chains or paths between the high voltage electrode and a ground return electrode. A moderately high current pulse subsequently delivered to the fuel mixture causes fusing of the chains or paths forming a resistive arc channel which in turn causes an increased dissipation of heat sufficient to initiate an exothermic reaction of the metal and oxidant.

Advantageously the present blasting apparatus only requires a moderately high amount of electrical energy to initiate the blasting and does so over a period of several milliseconds. Thus, the energy release through the chemical reaction of the metal powder and oxidant fuel mixture results in a blast that is a somewhat more akin to a controlled combustion process of a propellant rather than detonation of high energy explosives. The preferred amount of electrical energy required to initiate the aforementioned sequence is preferably only between about 5% and 15%, and most preferably between 5% and 10% of the resulting energy released by the subsequent metal and oxidant chemical reaction. For example, when using an aluminum powder and oxidant fuel mixture, the present blasting apparatus only requires between about 0.7 and 2.1 kilojoules of electrical energy per gram of aluminum powder. For an annular void region 10 centimeters in length, containing approximately 40 cubic centimeters of aluminum powder and water fuel mixture, successful fuel ignition and rock breaking has been accomplished with a capacitor energy of only 40 kilojoules, operating at about 10 kilovolts.

Referring now to FIG. 4, another embodiment of the blasting probe 14 is shown. This reusable blasting probe 14 essentially functions as a coaxial electrode and includes a centrally disposed high voltage electrode 42 disposed within an insulating tube 40. The insulating tube 40 includes an open proximal end 47 and an open distal end 43 near the forward section 60 of the blast probe 14. The centrally disposed high voltage electrode 42 extends beyond the distal end 43 of the insulating tube 40 and has a flange end 74 providing a ledge or shoulder 75 against which the insulating tube 40 abuts. Preferably, the outer diameter of the flange end 74 of the centrally disposed high voltage electrode 42 is just smaller than the diameter of the hole into which the blasting probe 14 is inserted.

A ground return electrode takes the form of a metal sheath 46 that is disposed on the outer surface of the insulating tube near the back section 59 of the blasting probe 14. The back section 59 of the blasting probe 14 is dimensioned such that it only a small clearance remains between the outer surface of the metal sheath 46 and the rock surface within the hole. The forward section 60 of the blasting probe has a smaller diameter than the back section 59 thus forming an annular void region 70 suitable for retaining an appropriate fuel mixture 72 to accomplish the blasting. The forward section 60 of the blasting probe 14 preferably has a diameter that is intermediate the diameter of the hole and the outer diameter of the centrally disposed electrode 42. The forward section 60 of the blast probe 14 also has a prescribed length which creates an annular void region 70 of a prescribed volume when the blasting probe 14 is inserted within the drilled hole.

Both the ground return electrode 46 and the high voltage electrode 42 are kept in communication with the annular void region 70 such that when the annular void region 70 is filled with a conductive fuel mixture 72, the circuit is complete. In the embodiment, the flange end 74 of the centrally disposed high voltage electrode 42 remains in communication with the conductive fuel mixture 72 present in the annular void region 70. An additional feature of the illustrated embodiment is the central fuel filling port 80 in the blasting apparatus 10 that allows for in-situ filling of the annular void region 70 with the metal powder and oxidizer fuel mixture 72. To accommodate the central fuel filling port 80, the centrally disposed electrode 42 must be of a sufficient diameter to perform the dual functions of transporting the fuel mixture 72 to the blast site and providing the high current pulse to initiate the blasting operation.

Where in-situ filling of the annular void region is not feasible, an appropriate volume of the fuel mixture is inserted into the hole prior to inserting the present blasting apparatus. It is also contemplated that one skilled in the art could design a non-conductive retaining sleeve or other suitable means for retaining the metal powder and oxidizer fuel mixture in the annular void region proximate the blasting probe where it is advantageous to pre-load the metal powder and oxidizer fuel mixture before positioning the blasting probe at the blasting site.

Figure 5:
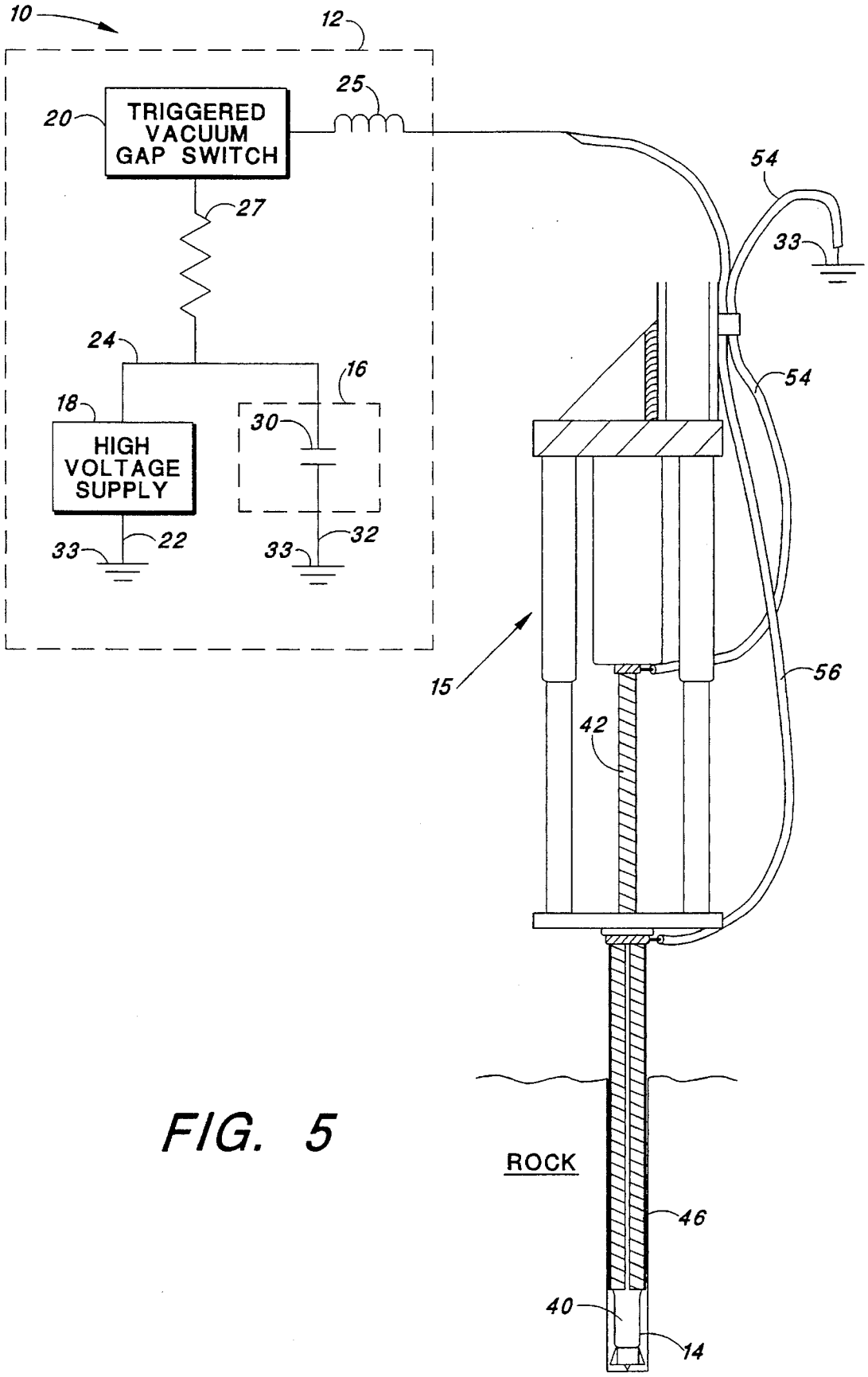
FIG. 5 is a schematic diagram of the blasting apparatus integrated with a rock drill in accordance with the present invention.

Referring now to FIGS. 5 through 8, an embodiment of the invention is shown wherein the blasting apparatus is integrated with a conventional rock drill. As seen in FIG. 5, the blasting apparatus 10 comprises a driver circuit 12 and a reusable blasting probe 14 associated with a rotating hammer rock drill 15. The reusable blasting probe 14 is essentially a coaxial electrode assembly formed with a metal sheath 46 disposed on a portion of the outer surface of an insulating tube 40 or sleeve. The metal sheath 46 is electrically coupled to a capacitor bank 16 in the driver circuit 12 via a high current switch 20. The insulating tube 40 is dimensioned to slide over the drill steel 42, between a drilling position (See FIG. 6) and a blasting position (See FIG. 7), with the drill steel 42 functioning as a ground return electrode.

As with the earlier described embodiment, the driver circuit 12 includes a conventional power supply 18 for charging the capacitor bank 16 which is comprised of a single 50-kilojoule capacitor 30 connected to the blasting probe 14 via the switching means which preferably includes a triggered vacuum gap switch 20 for controlling the flow of current from the capacitor bank 16 to the blasting probe 14. The driver circuit 12 also includes an inductive means which comprises a distributed inductance and is represented in FIG. 5 by inductor 25. The distributed inductance receives the current and slows the rate of change of the current supplied to the blasting probe 14. Other elements of the driver circuit are described above and will not be repeated here.

Figure 6:
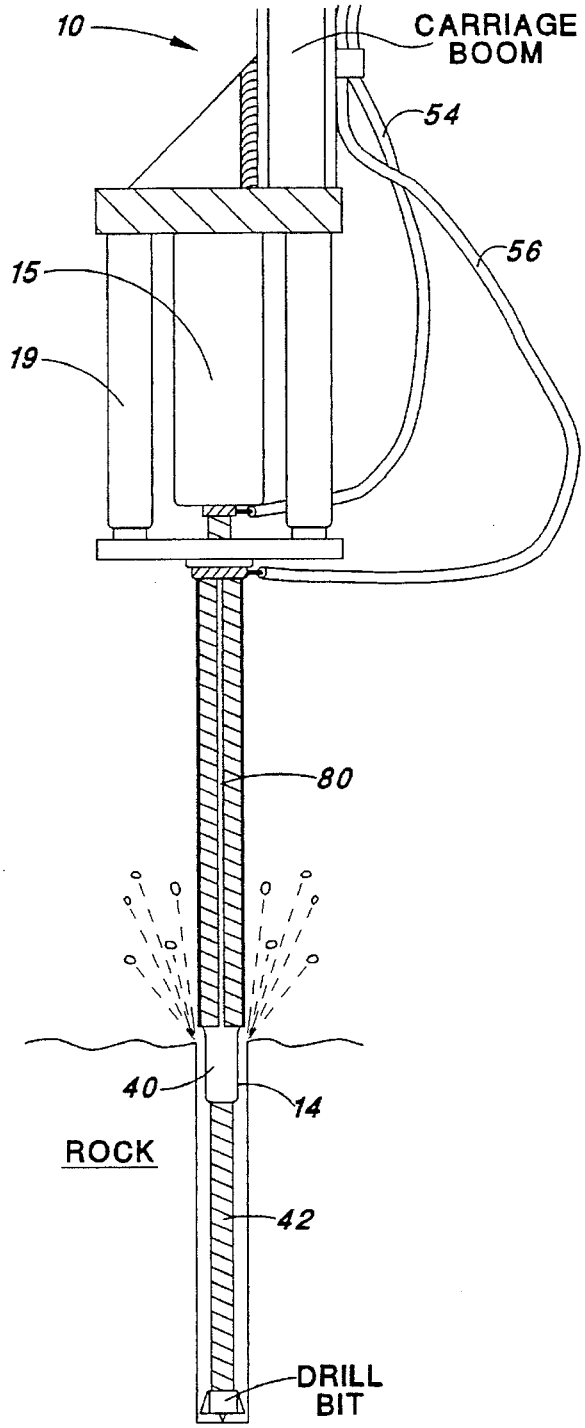
FIG. 6 is a partial view of the blasting apparatus integrated with a rock drill with the blasting probe retracted.
Figure 7:
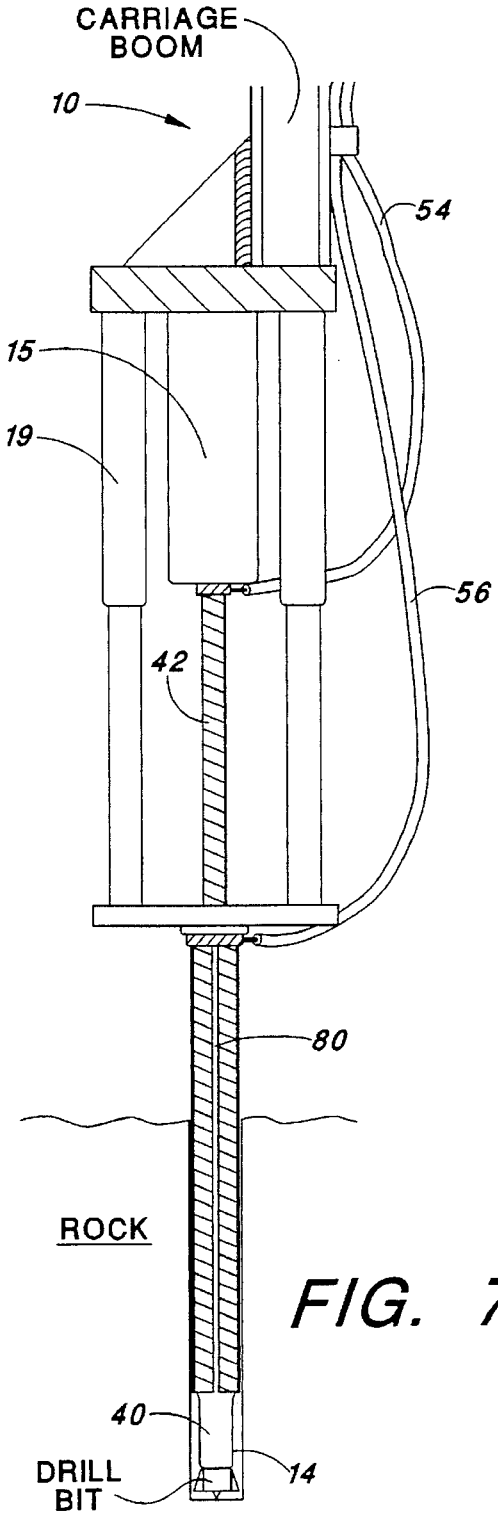
FIG. 7 is a partial view of the blasting apparatus integrated with a rock drill with the blasting probe inserted in the drill hole.

AS seen in FIG. 6, the blasting probe 14 is retracted up the drill steel 42 and away from the hole during the drilling operations. Upon completion of the drilling phase, the blasting probe 14 is inserted into the hole by sliding it down the shaft of the drill steel 2 as seen in FIG. 7. A hydraulic or pneumatic cylinder 9 can be used to drive the blasting probe 14 into position. The metal powder and oxidizer fuel mixture is then introduced into the newly drilled hole via a conduit 80 in the drill steel 42 after the blasting probe 14 is positioned or can be introduced from a separate nozzle prior to sliding the blasting probe into the hole.

Figure 8:
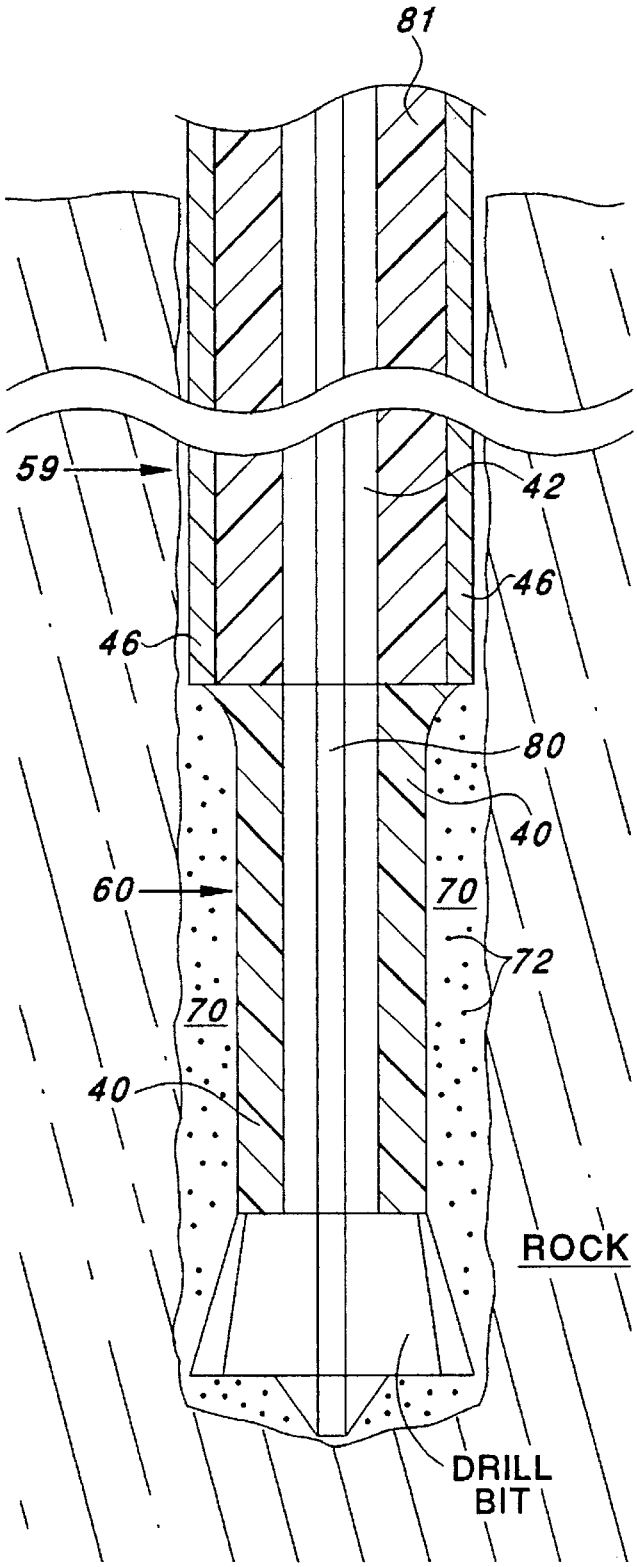
FIG. 8 is a cross-sectional view of the blasting probe shown in FIGS. 5, 6 and 7.

Referring now to FIG. 8, the dimensions and configuration of the reusable blasting probe 14 are particularly adapted to create an annular void region 70 of a prescribed volume when inserted within the drilled hole. The back section 59 of the blasting probe 14 has a metal sheath 46 placed on the outer surface of the insulating tube 40, and thus has an outer diameter that is preferably slightly smaller than the diameter of the hole. The forward section 60 of the blasting probe 14 has an outer diameter somewhat less than the back section 59 thereby creating an annular void region 70 proximate the forward section 60 of the blasting probe 14. This annular void region 70 is adapted for retaining a prescribed volume of a suitable working fluid, preferably a metal powder and oxidizer fuel mixture 72, and most preferably an aluminum powder and water with a gelling agent to prevent the aluminum particles from settling. The fuel mixture 72 is disposed within this annular void region 70 near the bottom of the hole and immediately behind the drill bit of the rock drill. The blasting probe 14 becomes active when this annular void region 70 is substantially filled with the fuel mixture 72 and the metal sheath 46 and the drill steel 42 are placed in contact therewith.

When pushed fully forward, the blasting probe comes into bearing against the rear of the rock bit. In order to provide good confinement of the subsequent blast, the insulating tube 40, or at least its back section 81 is preferably made of an elastomeric material such as polyurethane or silicone rubber so that it sealably deforms and/or expands radially against the rock face in the drilled hole when forced into the hole or is otherwise compressed. In addition, the metal sheath 46 at the back end 59 of the blasting probe 14 may include one or more longitudinal cuts to allow for the radial expansion.

When a current pulse is applied from the driver circuit to the metal sheath on the blasting probe, the metal particles within the metal powder and oxidizer fuel mixture fuse together to form a resistive arc channel between the metal sheath and the drill steel. As the voltage delivered to the electrodes rises, the resistive arc channel provides an increasing electrical resistance thereby causing an increased dissipation of heat which eventually initiates an exothermic reaction of the metal and oxidant generating high pressure gases within the hole and fracturing the surrounding rock. The blasting probe is then retracted up the drill steel and the drilling operations may resume.

It is thus apparent that the present invention provides a safe and inexpensive method and apparatus for blasting of hard rock using a highly insensitive metal powder and oxidant fuel mixture ignited with a moderately high energy electrical discharge. Moreover, the blasting technique and associated hardware are such that they can be easily integrated with conventional rock drills.

The present invention and its advantages will be understood from the foregoing description, and it will be apparent that numerous modifications and variations could be made thereto without departing from the spirit and scope of the invention or sacrificing all of its material advantages, the forms hereinbefore described being merely exemplary embodiments thereof. For example, while the above-described blasting apparatus integrated with conventional rock drills preferably uses a coaxial electrode assembly with a metal and oxidant fuel mixture to accomplish the blasting, other working fluids, inert or volatile, can be used with the slidable coaxial electrode assembly essentially as described above.

To that end, it is not intended that the scope of the invention be limited to the specific embodiments illustrated and described. Rather, it is intended that the scope of this invention be determined by the appending claims and their equivalents.

What is claimed is:

1. A blasting apparatus for blasting a solid, the blasting apparatus comprising:

capacitive means for storing electrical energy;

a blasting probe including a high voltage electrode and a ground return electrode separated by an insulating tube, the high voltage electrode switchably coupled to the capacitive means; and metal powder and oxidizer fuel mixture having a sufficiently high content of metal particles, the metal powder and oxidizer fuel mixture being in communication with the high voltage electrode and ground return electrode;

whereby the metal particles within the metal powder and oxidizer fuel mixture form one or more fusible metal paths between the high voltage electrode and the ground return electrode when subjected to an electric current delivered from the capacitive means via the high voltage electrode, the fusible metal paths providing a sufficiently high electrical resistance to allow coupling of the electrical energy from the capacitive means to the metal and oxidizer fuel mixture causing an increased dissipation of heat sufficient to initiate an exothermic reaction of the metal and oxidizer fuel mixture generating high pressure gases within a prescribed area which accomplish the blasting.

2. The blasting apparatus of claim 1 further comprising an inductive means coupled to the capacitive means to receive the charge delivered from the capacitive means and control the rate of change in the electric current delivered via the electrode to the metal powder and oxidizer fuel mixture.

3. The blasting apparatus of claim 1 wherein the blasting probe further includes:

a metal sheath disposed on an outer surface of the insulating tube proximate a back end of the blasting probe, the metal sheath forming one of the electrodes; and the other electrode disposed within the insulating tube and extending beyond a distal end of the insulating tube to be in communication with the metal powder and oxidizer fuel mixture.

4. The blasting apparatus of claim 3 wherein the insulating tube further defines an annular void region at the outer surface of the insulating tube, the annular void region adapted to receive the metal powder and oxidizer fuel mixture.

5. The blasting apparatus of claim 4 further comprising a means for filling the annular void region with metal powder and oxidizer fuel mixture.

6. The blasting apparatus of claim 4 further comprising a non-conducting sleeve for retaining the metal powder and oxidizer fuel mixture within the annular void region.

7. The blasting apparatus of claim 1, wherein said metal powder and oxidizer fuel mixture comprises aluminum particles suspended by a gelling agent in water.

8. The blasting apparatus of claim 7, wherein said metal powder and oxidizer fuel mixture comprises a mixture of 50% water, 50% aluminum powder and a small amount of the gelling agent.

9. The blasting apparatus of claim 1 further comprising a means for confining the blast to the prescribed area.

10. The blasting apparatus of claim 9 wherein the means for confining the blast to the prescribed area includes an elastomeric expandable element adapted for sealably isolating the blast probe thereby substantially preventing the high pressure gases from escaping via a blast hole.

11. A method for blasting hard rock comprising the steps of:

(a) placing a prescribed volume of a fuel mixture in communication with a pair of electrodes proximate the rock formation, the fuel mixture having a sufficiently high metal content so as to form a plurality of fusible metal paths between the electrodes;

(b) applying a moderately high electrical energy discharge to the volume of the fuel mixture;

(c) fusing the plurality of metal paths to form a resistive arc channel between electrodes within the fuel mixture thereby producing a sufficiently high electrical resistance; and (d) dissipating a sufficient amount of heat from the resistive arc to the fuel mixture to initiate an exothermic reaction of the fuel mixture generating a rapidly expanding gas causing the fracturing and break up of the hard rock.

12. The method of claim 11, wherein the step of applying a moderately high electrical energy discharge to the volume of the fuel mixture further comprises coupling a prescribed amount of electrical energy to the volume of the fuel mixture, the prescribed amount of electrical energy being between about 5% and 15% of the energy released by the subsequent exothermic reaction.

13. The method of claim 11, wherein the step of applying a moderately high electrical energy discharge to the volume of the fuel mixture further comprises coupling a prescribed amount of electrical energy to the volume of the fuel mixture, the prescribed amount of electrical energy being about 10% of the energy released by the subsequent exothermic reaction.

14. The method of claim 13, wherein the fuel mixture comprises a metal powder and oxidizer fuel mixture that exothermically reacts at a prescribed temperature to generate the rapidly expanding gas.

15. The method of claim 14, wherein the metal powder and oxidizer fuel comprises a mixture of water and aluminum powder together with a small amount of the gelling agent.

16. The method of claim 13, wherein the fuel mixture comprises metal particles suspended by a gelling agent in water wherein the metal particles exothermically react with water providing the rapidly expanding gas.

17. A blasting apparatus integrated with a rock drill, the blasting apparatus comprising:

capacitive means for storing electrical energy;

an insulating tube adapted to slidably traverse an elongated drill steel of the rock drill between a first position and a second position, the first position being a drilling position to allow drilling operations to proceed without interference from the insulating tube and the second position being a blasting position; and a metal sheath disposed on the outer surface of the insulating tube, the metal sheath switchably coupled to the capacitive means;

wherein the drill steel is further connected to a ground potential, and the insulating tube, metal sheath and drill steel form a coaxial electrode assembly suitable for coupling the electrical energy from the capacitive means to a prescribed working fluid placed in communication with the metal sheath and drill steel.

18. The blasting apparatus of claim 17 further comprising a means for selectively moving the insulating tube between the drilling position and the blasting position.

19. The blasting apparatus of claim 17 wherein the insulating tube, when disposed in the blast position, further defines an annular void region at the outer surface of the insulating tube, the annular void region adapted to receive the working fluid.

20. The blasting apparatus of claim 19 further comprising a means for filling the annular void region with the working fluid.

21. The blasting apparatus of claim 20 wherein the working fluid is a metal powder and oxidizer fuel mixture having a sufficiently high content of metal particles, the metal powder and oxidizer fuel being placed in communication with the metal sheath and the drill steel;

whereby the metal particles within the metal powder and oxidizer fuel mixture form one or more fusible metal paths between the metal sheath and the drill steel when subjected to an electric current delivered from the capacitive means, the fusible metal paths providing a sufficiently high electrical resistance to allow coupling of the electrical energy from the capacitive means to the metal and oxidizer fuel mixture causing an increased dissipation of heat sufficient to initiate an exothermic reaction of the metal and oxidizer fuel mixture generating high pressure gases within a prescribed area which accomplish the blasting.

22. The blasting apparatus of claim 21, wherein said metal powder and oxidizer fuel mixture comprises aluminum particles suspended by a gelling agent in water.

23. The blasting apparatus of claim 22, wherein said metal powder and oxidizer fuel mixture comprises a mixture of 50% water, 50% aluminum powder and a small amount of the gelling agent.

24. The blasting apparatus of claim 21 further comprising an inductive means coupled to the capacitive means to receive the charge delivered from the capacitive means and control the rate of change in the electric current delivered to the metal powder and oxidizer fuel mixture.

25. The blasting apparatus of claim 21 further comprising a means for confining the subsequent blast to the prescribed area.

26. The blasting apparatus of claim 25 wherein the means for confining the subsequent blast to the prescribed area includes an elastomeric element attached to the insulating tube and adapted for sealably isolating the insulating tube in the blast position thereby substantially preventing the high pressure gases from escaping via the drill hole.

* * * * *